US006537120B1

(12) United States Patent
Yoo

(10) Patent No.: US 6,537,120 B1
(45) Date of Patent: Mar. 25, 2003

(54) METHOD OF MANUFACTURING BARRIER RIBS OF PLASMA DISPLAY PANEL

(75) Inventor: Min-sun Yoo, Cheonan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 335 days.

(21) Appl. No.: 09/713,290

(22) Filed: Nov. 16, 2000

(30) Foreign Application Priority Data

Nov. 17, 1999 (KR) ..... 99-51060

(51) Int. Cl.[7] ..... H01J 9/00; H01J 9/24

(52) U.S. Cl. ..... 445/24; 445/25; 313/292; 313/582; 313/495

(58) Field of Search ..... 445/24, 25; 313/582, 313/583, 584, 585, 586, 587, 484, 292

(56) References Cited

U.S. PATENT DOCUMENTS 5,526,151 A 6/1996 Miyazaki et al. ..... 359/87

5,810,634 A 9/1998 Miyazaki et al. ..... 445/25

FOREIGN PATENT DOCUMENTS

JP 06267423 A * 9/1994 ..... H01J/9/24
JP 10116557 A * 5/1998 ..... H01J/9/02
JP 2000340104 A * 12/2000 ..... H01J/9/02

* cited by examiner

*Primary Examiner*—Kenneth J. Ramsey
*Assistant Examiner*—Mariceli Santiago
(74) *Attorney, Agent, or Firm*—Leydig, Voit & Mayer, Ltd.

(57) ABSTRACT

Barrier ribs of a plasma display panel are manufactured by a) forming barrier ribs having predetermined thicknesses on a substrate where electrodes are formed, b) heating the barrier ribs to a maximum baking temperature to bake the barrier ribs, c) cooling the barrier ribs to an intermediate temperature lower than the maximum baking temperature, d) pressing upper portions of the barrier ribs by using a planarization roller at the intermediate temperature so as to make upper surfaces of the barrier ribs plane, and e) cooling the barrier ribs to a room temperature.

11 Claims, 5 Drawing Sheets

METHOD OF MANUFACTURING BARRIER RIBS OF PLASMA DISPLAY PANEL

BACKGROUND OF THE INVENTION

1. Field of the Invention

The present invention relates to a method of manufacturing barrier ribs of a plasma display panel, and more particularly, to a method of manufacturing barrier ribs of a plasma display panel by which the upper surface of barrier ribs can be effectively made planar during a baking process.

2. Description of the Related Art

A typical plasma display panel displays an image by using a gas discharge phenomenon and is well known as a display device capable of replacing a CRT since it has superior display features in display capacity, brightness, contrast, and a viewing angle. In the plasma display panel, a discharge is generated in a gas between electrodes by applying a DC or AC voltage applied to the electrodes and ultraviolet rays are radiated and excite a fluorescent substance so that light is emitted.

The plasma display panel can be divided into an AC type and a DC type according to a discharge mechanism. The DC type plasma display panel has a structure in which electrodes are directly exposed to a discharge gas in a sealed discharge cell. In the DC type plasma display panel, charged particles directly move between the corresponding electrodes. In the AC type plasma display panel, electrodes are embedded in a dielectric layer. Here, charged particles do not directly move between the corresponding electrodes. Instead, the discharge is performed by wall charges.

FIG. 1 shows the structure of a typical AC type plasma display panel. Referring to the drawing, a first electrode 13*a*, which is a transparent display electrode, and a second electrode 13*b*, which is an address electrode, are located between a front substrate 11 and a rear substrate 12. The first and second electrodes 13*a* and 13*b* are formed in stripes on the inner surfaces of the front and rear substrates 11 and 12, respectively. When the front and rear substrates 11 and 12 are coupled to each other, the first electrode 13*a* and the second electrode 13*b* perpendicularly cross each other. A first dielectric layer 14 and a protective film 15 are deposited in order on the inner surface of the front substrate 11. A second dielectric layer 16 is formed on the rear substrate 12 and a plurality of barrier ribs 17 are formed on the upper surface of the second dielectric layer 16. A discharge cell 19 is defined by the barrier ribs 17 and the discharge cell 19 is filled with a discharge gas. Also, phosphor 18 coats the surfaces of the barrier ribs 17 forming the discharge cell and the upper surface of the second dielectric layer 16.

In the operation of a plasma display panel having the above structure, a high voltage, which is called a trigger voltage, is applied to the electrodes 13*a* and 13*b* in order to generate a discharge between the electrodes 13*a* and 13*b*. When the trigger voltage exceeds a threshold voltage, the discharge gas inside the discharge cell 19 turns to a plasma state due to the discharge and a stable discharge state is maintained between the electrodes 13*a* and 13*b*. In the stable discharge state, ultraviolet rays are generated to and irradiate the phosphor 18 and accordingly the phosphor 18 emits light. Consequentially, pixels of each of the discharge cells 19 can display an image.

As described above, the barrier ribs 17 provide space where the phosphor 18 is present and have a function of sectioning the discharge space. The barrier ribs 17 can be manufactured in a screen printing method, a sandblasting method, or a photolithography method.

In the screen printing method, barrier ribs are formed by repeatedly printing and drying paste which is a material for the barrier ribs in a screen print process on a rear substrate formed of glass material. Then, the barrier ribs are completed by a baking process.

In the sandblast method which is widely used, material for the barrier ribs is applied to the glass rear substrate in a predetermined thickness, and dried. Then, after a protective film having the shape of desired barrier ribs is formed thereon, or after a mask for sand blasting is inserted, sand is injected at a high pressure so that unnecessary portions are removed, thus forming the barrier ribs. The barrier ribs are completed by a baking process.

FIGS. 2A through 2F show steps of manufacturing the barrier ribs of the plasma display panel according to the sand blasting. Referring to the drawings, paste 30, which is material for the barrier ribs, uniformly coats a glass substrate 20 (FIG. 2A). The paste 30 is covered with photoresist 40 exhibiting great resistance with respect to the sandblast (FIG. 2B). When the photoresist 40 is exposed to ultraviolet light using a photo mask 45 (FIG. 2C), portions exposed to the ultraviolet light become chemically stable. By developing the exposed photoresist, resist 50 having the same pattern as the barrier ribs is formed (FIG. 2D). Next, when abrasive grains are injected at a high pressure, the material for the barrier ribs where the resist 50 is not attached is removed (FIG. 2E). Finally, after the remaining resist 50 is detached, the material for the barrier ribs is baked and a barrier rib 37 is completed (FIG. 2F).

In the photolithography method, photosensitive glass paste, which will be barrier ribs is uniformly printed on a glass substrate and the printed paste is exposed and patterned to form the barrier ribs. Then, the barrier ribs, are completed by a baking process.

The barrier ribs formed by these methods should have flat upper surfaces and the heights of the barrier ribs should be uniform throughout the entire barrier ribs. If the upper surfaces of the barrier ribs are not planar or the heights thereof are not uniform, when the front substrate and the rear substrate are coupled to each other forming a seal, gaps may be generated between the upper surfaces of the barrier ribs and the lower surface of the front substrate. Thus, cross talk is generated between discharge cells formed by the barrier ribs, so that brightness and contrast of a plasma display panel are deteriorated.

As a method for making the barrier ribs plane, a method for baking barrier ribs and polishing them has been used. However, according to this method, the barrier ribs may be damaged during a polishing process. To solve the above problem, U.S. Pat. Nos. 5,526,151 and 5,810,634 disclose methods of filling spaces between the barrier ribs and removing the reinforcing material after a polishing process, which makes the process complicated. Thus, a method of manufacturing the barrier ribs while securing the planar upper surfaces in a simplified process, is needed.

SUMMARY OF THE INVENTION

To solve the above problems, it is an object of the present invention to provide a method of manufacturing the barrier ribs of a plasma display panel by which the upper surfaces of the barrier ribs are made planar.

Accordingly, to achieve the above object, there is provided a method of manufacturing barrier ribs of a plasma display panel which comprises the steps of a) forming barrier ribs having predetermined thicknesses on a substrate where electrodes are formed, b) heating the barrier ribs to a maximum baking temperature to bake the barrier ribs, c) cooling the barrier ribs to an intermediate temperature lower than the maximum baking temperature, d) pressing upper portions of the barrier ribs by using a planarization roller at the intermediate temperature so as to make upper surfaces of the barrier ribs plane, and e) cooling the barrier ribs to a room temperature.

It is preferred in the present invention that, in the step (d), the barrier ribs are moved in a lengthwise direction of the barrier ribs to perform planarization, and that, when material for the barrier ribs includes aluminum oxide by 60through 70%, an appropriate temperature for planarization is in a range of 500 through 600° C., which is about 20 through 30° C. lower than the maximum baking temperature of the barrier ribs.

To achieve the above object, there is provided a method of manufacturing barrier ribs of a plasma display panel which comprises the steps of a) forming barrier ribs having predetermined thicknesses on a substrate where electrodes are formed, b) heating the barrier ribs to an intermediate temperature lower than a maximum baking temperature, c) pressing upper portions of the barrier ribs by using a planarization roller at the intermediate temperature so as to make upper surfaces of the barrier ribs plane, d) heating the barrier ribs to the maximum baking temperature to bake the barrier ribs, and e) cooling the barrier ribs to a room temperature.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
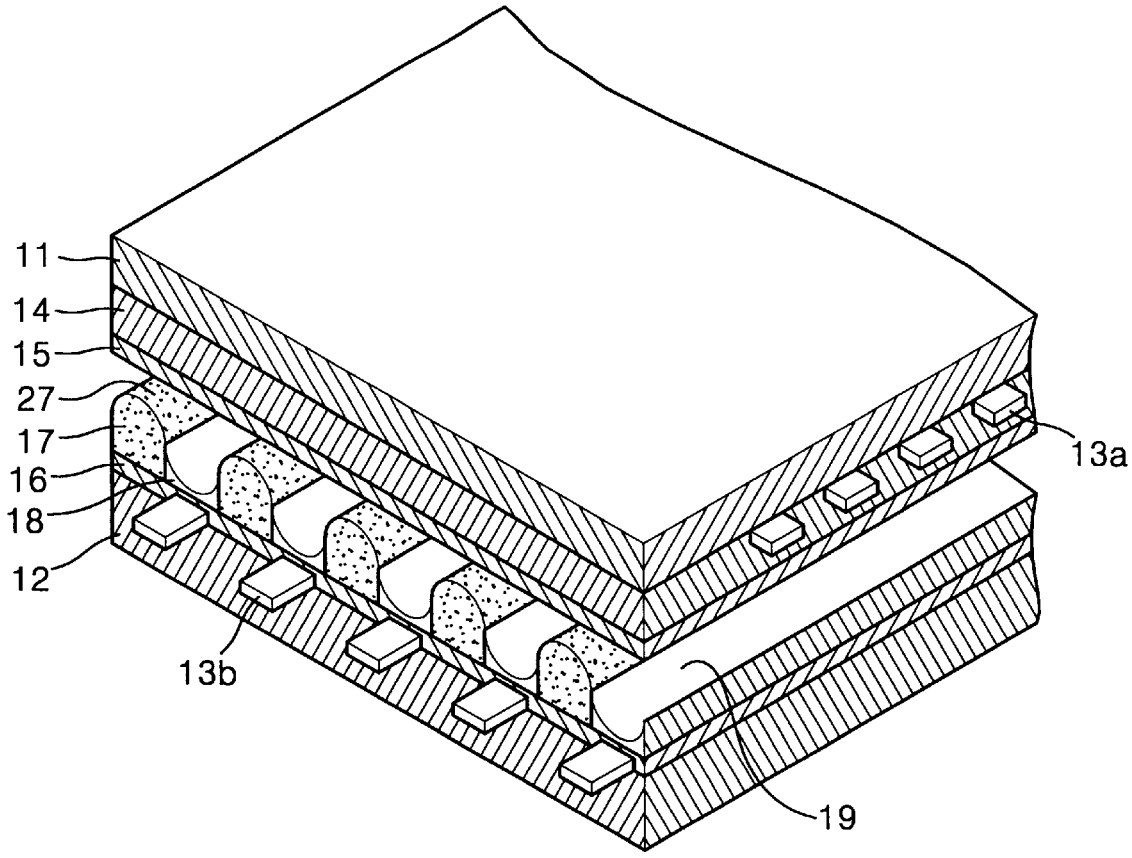
FIG. 1 is a perspective view showing the structure of a conventional AC type plasma display panel.
Figure 2A:
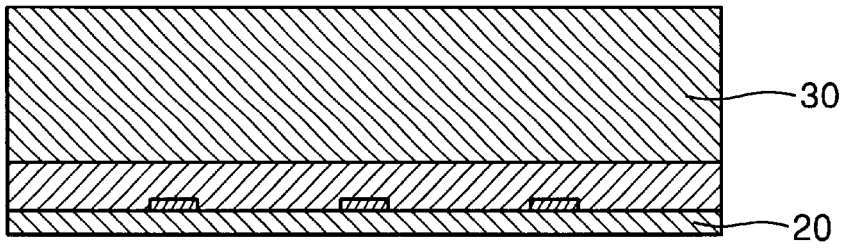
FIGS. 2A–2F are views showing steps of manufacturing the barrier ribs using the sandblasting method.
Figure 2B:
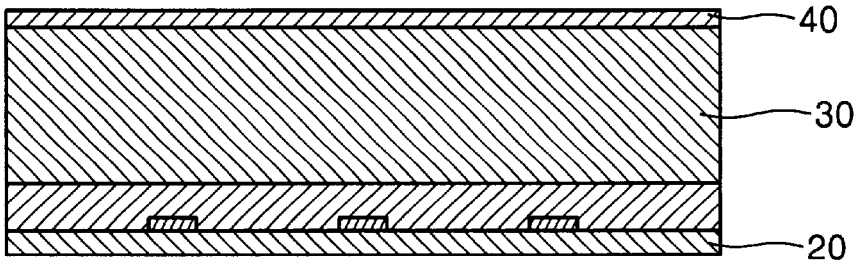
Figure 2C:
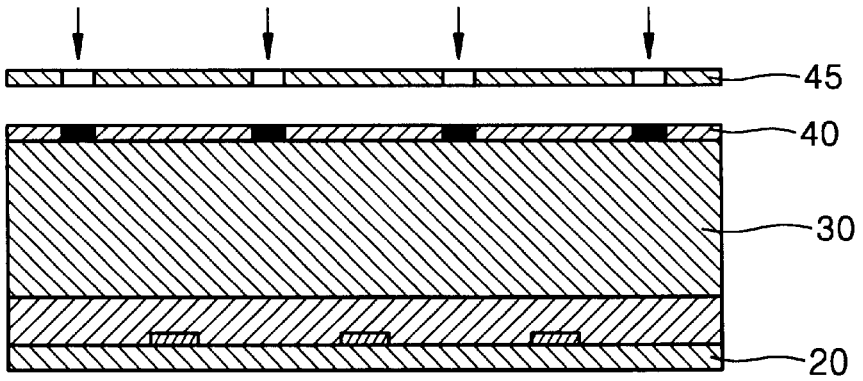
Figure 2D:
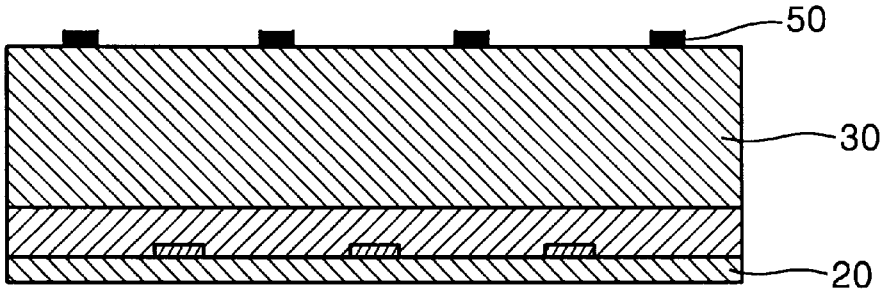
Figure 2E:
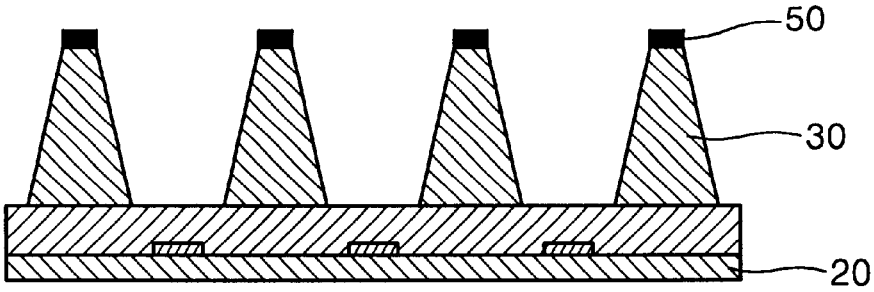
Figure 2F:
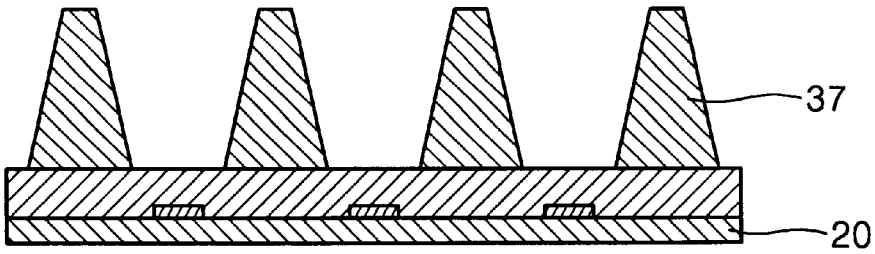
Figure 3:
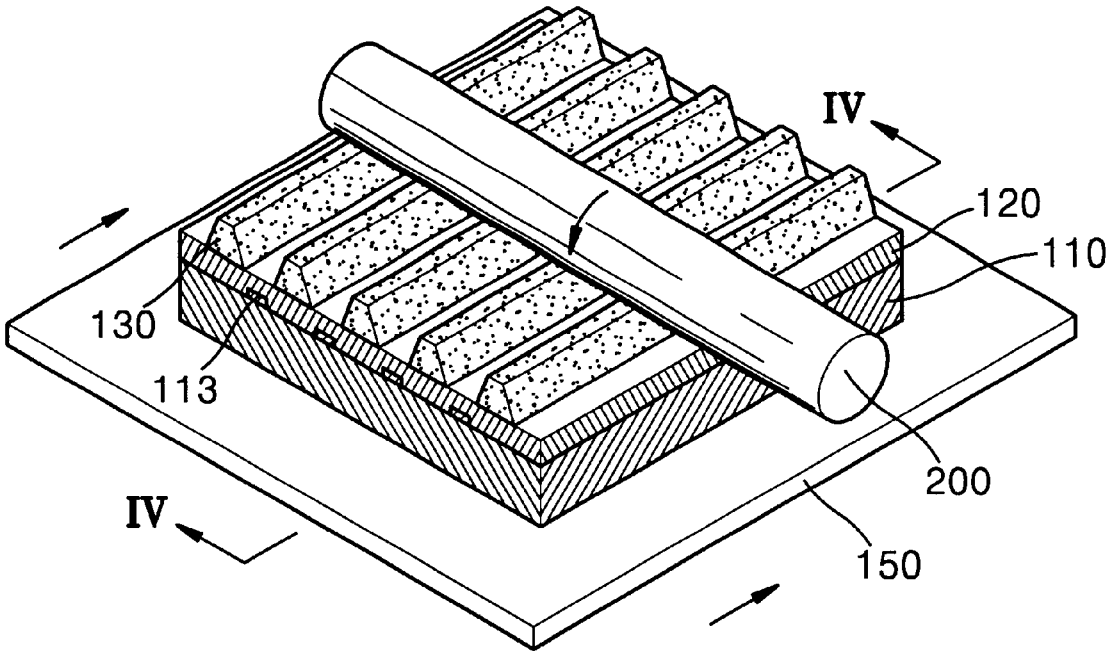
FIG. 3 is a perspective view showing a step of making the upper surfaces of the barrier ribs planar according to the present invention.
Figure 4:
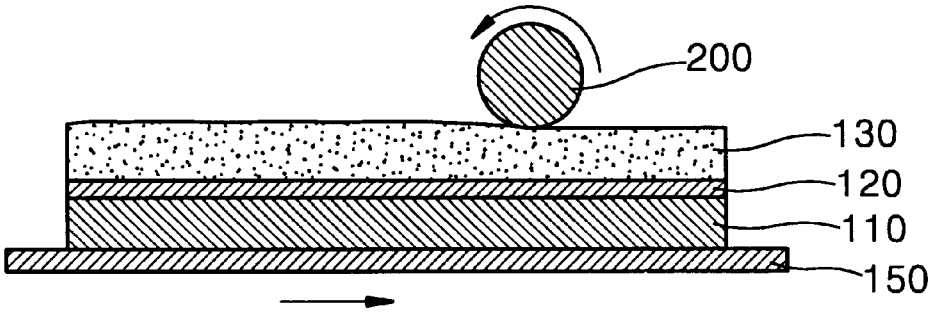
FIG. 4 is a sectional view taken along line IV—IV of FIG. 3.
Figure 5:
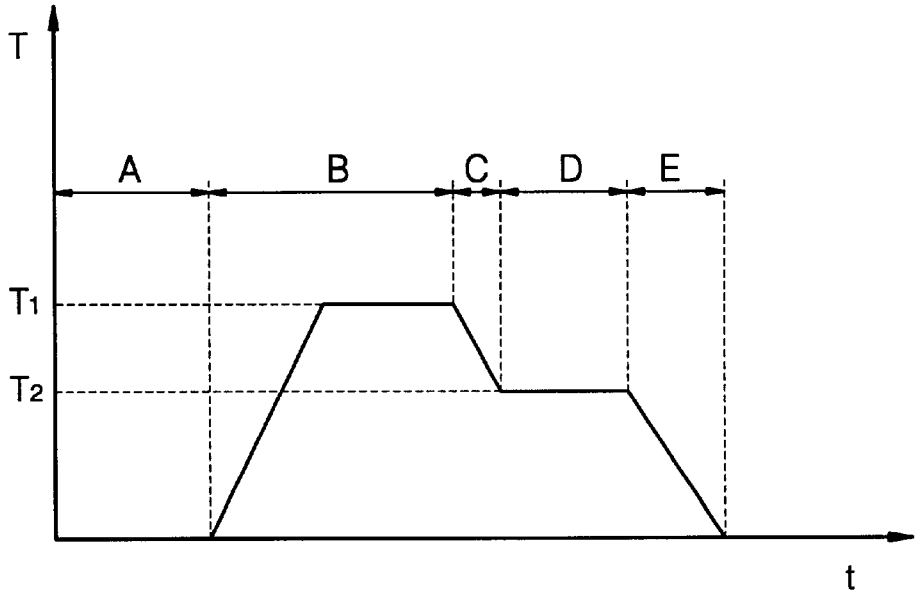
FIG. 5 is a graph showing the relationship between the temperature of the barrier ribs and the time of each of the steps of manufacturing of the barrier ribs according to a preferred embodiment of the present invention.

Referring to FIG. 5, barrier ribs are formed to have predetermined thicknesses on a substrate where electrodes are formed (Step A). Here, a screen printing method, a sandblasting method or photolithography method may be used as a method of forming the barrier ribs. Next, the barrier ribs are heated to a maximum baking temperature $T_1$, for example, 520–630° C., and baked (Step B). The barrier ribs heated to the maximum baking temperature $T_1$ are cooled to an intermediate temperature $T_2$ (Step C). Here, the intermediate temperature $T_2$ is a temperature of the barrier ribs at which the upper surfaces of the barrier ribs are made planar, which may vary according to the material of the barrier ribs. At the intermediate temperature $T_2$, the barrier ribs are appropriately softened such that the upper surfaces of the barrier ribs can be made planar by a planarization roller pressing the upper portions of the barrier ribs which will be described later. Material for the barrier ribs including 60–70% aluminum oxide is generally used. In this case, the intermediate temperature $T_2$ of the barrier ribs for a planarization process is 500–600° C., which is about 20–30° C. lower than the maximum baking temperature $T_1$. Next, at the intermediate temperature $T_2$, the planarization roller presses the upper portions of the barrier ribs so that the upper surfaces of the barrier ribs are made planar (Step D). Here, the operation of making the upper surfaces of the barrier ribs planar by using the planarization roller pressing the upper portions of the barrier ribs is shown in FIGS. 3 and 4, which will be described later. Finally, the planarized barrier ribs are cooled to the room temperature (Step E).

Referring to FIGS. 3 and 4, a substrate 110 including barrier ribs 130 which are softened at the intermediate temperature $T_2$ described above with reference to FIG. 5, is installed on a pallet 150. Next, the pallet 150 is moved toward a planarization roller 200. Here, the pallet 150 is preferably moved in a lengthwise direction of the barrier ribs 130. Then, the planarization roller 200 fixedly installed at a predetermined height rotates while pressing the upper portions of the barrier ribs 130 on the pallet 150 which moves. Here, the planarization roller 200 is continuously maintained at the same height and the barrier ribs 130 are appropriately softened. Thus, since the upper portions of the barrier ribs 130 are pressed by the planarization roller 200, the heights of the barrier ribs 130 is uniform and the upper surfaces of the barrier ribs 130 are made planar. Reference numerals 113 and 120 in FIGS. 3 and 4 denote a plurality of electrodes and a dielectric layer formed on the substrate, respectively.

Although an example in which the barrier ribs formed on the substrate are installed on a pallet and moved has been described, it may be possible that the planarization roller moves over the upper portions of the barrier ribs while maintaining the same heights, or both the planarization roller and the barrier ribs concurrently move. Here, the planarization roller and/or the barrier ribs preferably move in the lengthwise direction of the barrier ribs as described above.

Figure 6:
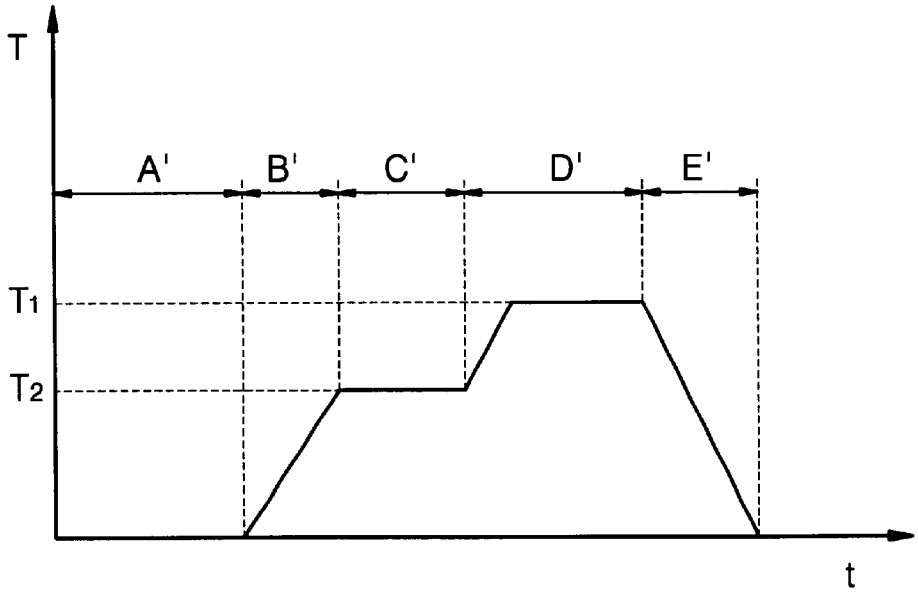
FIG. 6 is a graph showing the relationship between the temperature of the barrier ribs and the time in each of the steps of manufacturing the barrier ribs according to another preferred embodiment of the present invention

Referring to FIG. 6, in a method of manufacturing barrier ribs according to another preferred embodiment of the present invention, the barrier ribs have predetermined thicknesses on the substrate where the electrodes are formed (Step A'). The barrier ribs are heated to an intermediate temperature $T_2$ lower than the maximum baking temperature $T_1$. (Step B'). Here, the maximum baking temperature $T_1$ and the intermediate temperature $T_2$ are the same as those described with reference to FIG. 5. Next, the planarization roller presses the upper portions of the barrier ribs at the intermediate temperature $T_2$ to make the upper surfaces of the barrier ribs planar (Step C'). Here, the steps of making the upper surfaces of the barrier ribs planar are the same as those described with reference to FIGS. 3 and 4. Next, the planarized barrier ribs are heated to the maximum baking temperature $T_1$ and baked (Step D'). Finally, the barrier ribs are cooled to the room temperature (Step E').

As described above, the method of manufacturing the barrier ribs according to the present invention include planarizing the upper surfaces of the barrier ribs on the substrate at intermediate temperature $T_2$ which is lower than the maximum baking temperature $T_1$. Thus, barrier ribs having the uniform heights and planar upper surfaces can be manufactured, so that, when the rear substrate including the barrier ribs is coupled to the front substrate, forming a seal, gaps between the upper surfaces of the barrier ribs and the lower surface of the front substrate are prevented. As a result, cross talk between the neighboring discharge cells can be prevented.

What is claimed is:

1. A method of manufacturing barrier ribs of a plasma display panel comprising:

forming barrier ribs having thicknesses on a substrate where electrodes are located;

heating the barrier ribs to a maximum baking temperature to bake the barrier ribs;

cooling the barrier ribs to an intermediate temperatures lower than the maximum baking temperature;

pressing the barrier ribs using a planarization roller at the intermediate temperature to make upper surfaces of the barrier ribs planar; and cooling the barrier ribs to room temperature.

2. The method as claimed in claim 1, including moving the barrier ribs in a lengthwise direction of the barrier ribs while pressing the barrier ribs.

3. The method as claimed in claim 1, wherein the barrier ribs include 60 to 70% aluminum oxide, the maximum baking temperature is in a range of 520 through 630° C., and the intermediate temperature is 20 through 30° C. lower than the maximum baking temperature.

4. The method as claimed in claim 2, wherein the barrier ribs include 60 to 70% aluminum oxide, the maximum baking temperature is in a range of 520 through 630° C., and the intermediate temperature is 20 through 30° C. lower than the maximum baking temperature.

5. The method as claimed in claim 1, including forming the barrier ribs by one of a screen printing, sandblasting, and photolithography.

6. The method as claimed in claim 2, including forming the barrier ribs by one of a screen printing, sandblasting, and photolithography.

7. The method as claimed in claim 4, including forming the barrier ribs by one of a screen printing, sandblasting, and photolithography.

8. A method of manufacturing barrier ribs of a plasma display panel comprising:

forming barrier ribs having thicknesses on a substrate where electrodes are located;

heating the barrier ribs to an intermediate temperature, lower than a maximum baking temperature;

pressing the barrier ribs using a planarization roller at the intermediate temperature to make upper surfaces of the barrier ribs planar;

heating the barrier ribs to the maximum baking temperature to bake the barrier ribs; and cooling the barrier ribs to room temperature.

9. The method as claimed in claim 8, including moving the barrier ribs in a lengthwise direction of the barrier ribs while pressing the barrier ribs.

10. The method as claimed in claim 8, wherein the barrier ribs include 60 to 70% aluminum oxide, the maximum baking temperature is in a range of 520 through 630° C., and the intermediate temperature is 20 through 30° C. lower than the maximum baking temperature.

11. The method as claimed in claim 9, wherein the barrier ribs include 60 to 70% aluminum oxide, the maximum baking temperature is in a range of 520 through 630° C., and the intermediate temperature is 20 through 30° C. lower than the maximum baking temperature.

* * * * *